US006176462B1

(12) United States Patent
Jansen

(10) Patent No.: US 6,176,462 B1
(45) Date of Patent: Jan. 23, 2001

(54) STAKE PROTECTOR

(76) Inventor: Ralph F. Jansen, 5340 E. Yucca St., Scottsdale, AZ (US) 85254

( * ) Notice: Under 35 U.S.C. 154(b), the term of this patent shall be extended for 0 days.

(21) Appl. No.: 09/220,947

(22) Filed: Dec. 24, 1998

(51) Int. Cl.[7] ..... E04G 17/00
(52) U.S. Cl. ..... 249/3; 249/208
(58) Field of Search ..... 249/3, 4, 5, 6, 249/7, 208; 135/118; 52/102, 301

(56) References Cited

U.S. PATENT DOCUMENTS 1,472,018 * 10/1923 Heltzel ..... 249/6
1,814,521 * 7/1931 Miller ..... 249/3
3,256,659 * 6/1966 Dudoff ..... 52/301
3,288,426 * 11/1966 Simpson ..... 249/194

* cited by examiner

*Primary Examiner*—Michael Safavi

(57) ABSTRACT

A securing apparatus including cap adapted for slidably receiving a top end of a stake. Also included is an alignment member adapted for receiving a top edge of a form board and for slidably receiving the stake such that stake is rigidly held substantially parallel to the form board. The alignment member possesses a sleeve as well as L-shaped holding portion adapted to fit over the top edge of a form board. The alignment member possesses a sleeve as well as L-shaped holding portion adapted to fit over the top edge of a form board.

7 Claims, 2 Drawing Sheets

STAKE PROTECTOR

BACKGROUND OF THE INVENTION

1. Field of the Invention

The present invention relates to foundation form braces and more particularly pertains to a new stake protector for protecting stakes used in concrete form construction from being damaged.

2. Description of the Prior Art

The use of foundation form braces is known in the prior art. More specifically, foundation form braces heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,076,535; 5,616,272; 1,329,177; 4,411,404; 1,727,250; and U.S. Pat. No. Des. 317,250.

In these respects, the stake protector according to the present invention substantially departs from the conventional concepts and designs of the prior art, and in so doing provides an apparatus primarily developed for the purpose of protecting stakes used in concrete form construction from being damaged.

SUMMARY OF THE INVENTION

In view of the foregoing disadvantages inherent in the known types of foundation form braces now present in the prior art, the present invention provides a new stake protector construction wherein the same can be utilized for protecting stakes used in concrete form construction from being damaged.

The general purpose of the present invention, which will be described subsequently in greater detail, is to provide a new stake protector apparatus and method which has many of the advantages of the foundation form braces mentioned heretofore and many novel features that result in a new stake protector which is not anticipated, rendered obvious, suggested, or even implied by any of the prior art foundation form braces, either alone or in any combination thereof.

To attain this, the present invention is adapted for use with a form board and a stake. The form board has a planar exterior surface and a top edge. The stake has a pair of side edges, a top end, a pointed end, a front surface and a back surface. The present invention includes a cap having a planar rectangular top member and an encasement member. The encasement member includes a front wall, a rear wall and a pair of side walls. The front wall and the rear wall are fixedly coupled to the side walls to form a first rectangular bore. The top member is fixedly coupled to the encasement member such that a lip protrudes away from the encasement member around the periphery of the encasement member. Wherein the cap is for slidably receiving the top end of the stake. Also included is an alignment member having a rectangular sleeve portion and a pair of holding portions. The rectangular sleeve portion includes an exterior wall, an interior wall and a pair of side walls. The exterior wall and the interior wall are fixedly attached to the side walls to form a second rectangular bore. The second rectangular bore is for slidably receiving the front surface, the back surface and the side edges of the stake. Each of the holding portions includes an L-shaped rod. The L-shaped rod includes a free end and a fixed end. The fixed end is rigidly coupled to the sleeve portion adjacent to an outer top edge of one of the side walls of the sleeve portion. Each of the holding portions is adapted for receiving the top edge of the form board.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new stake protector apparatus and method which has many of the advantages of the foundation form braces mentioned heretofore and many novel features that result in a new stake protector which is not anticipated, rendered obvious, suggested, or even implied by any of the prior art foundation form braces, either alone or in any combination thereof.

It is another object of the present invention to provide a new stake protector which may be easily and efficiently manufactured and marketed.

It is a further object of the present invention to provide a new stake protector which is of a durable and reliable construction.

An even further object of the present invention is to provide a new stake protector which is susceptible of a low cost of manufacture with regard to both materials and labor, and which accordingly is then susceptible of low prices of sale to the consuming public, thereby making such stake protector economically available to the buying public.

Still yet another object of the present invention is to provide a new stake protector which provides in the apparatuses and methods of the prior art some of the advantages thereof, while simultaneously overcoming some of the disadvantages normally associated therewith.

Still another object of the present invention is to provide a new stake protector for protecting stakes used in concrete form construction from being damaged.

Yet another object of the present invention is to provide a new stake protector which includes a cap adapted for slidably receiving the top end of a ground engaging means. Also include is an alignment member which is adapted for receiving the top edge of concrete retaining means.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
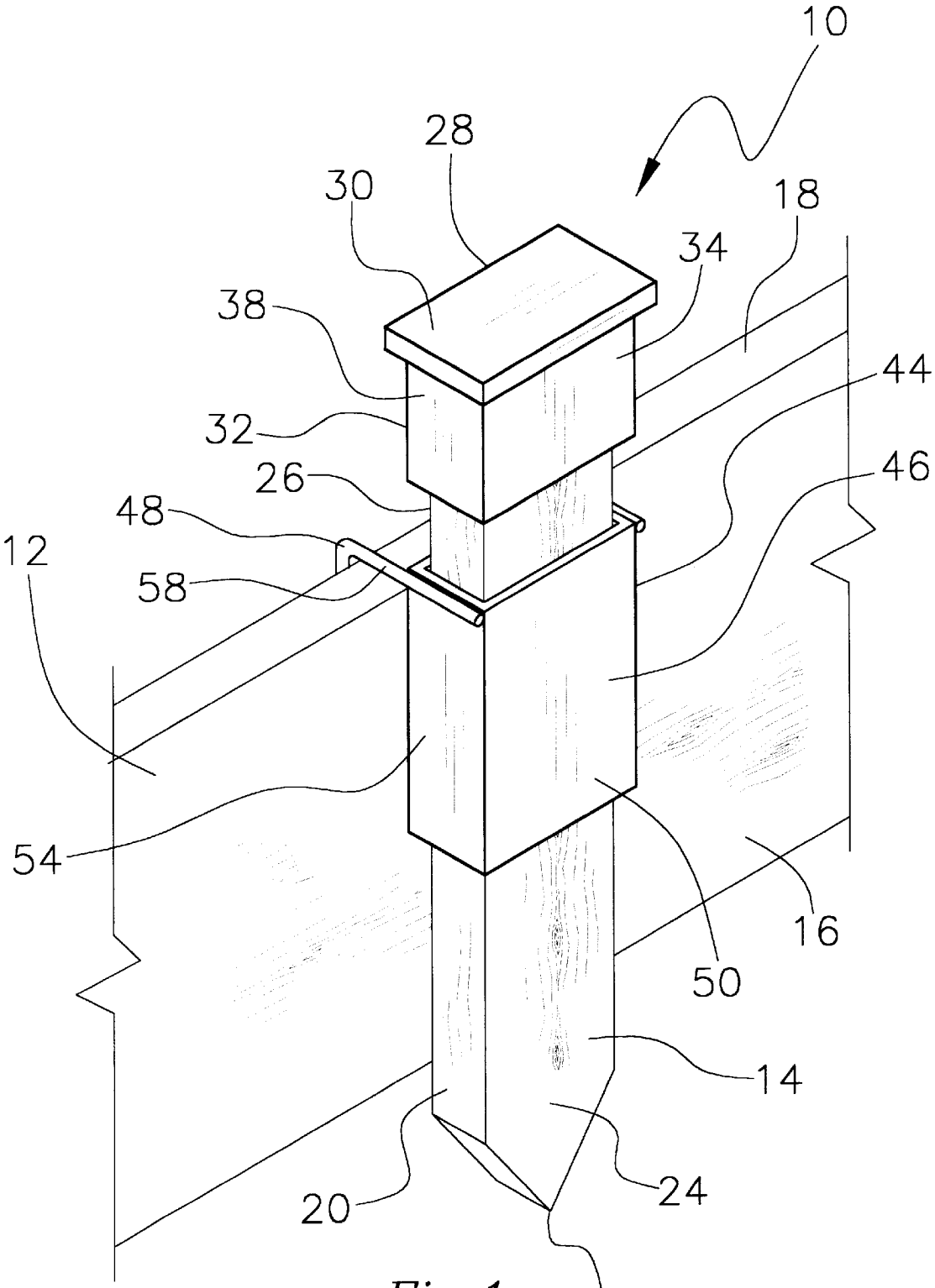
FIG. 1 is an assembled perspective view of a new stake protector according to the present invention.
Figure 2:
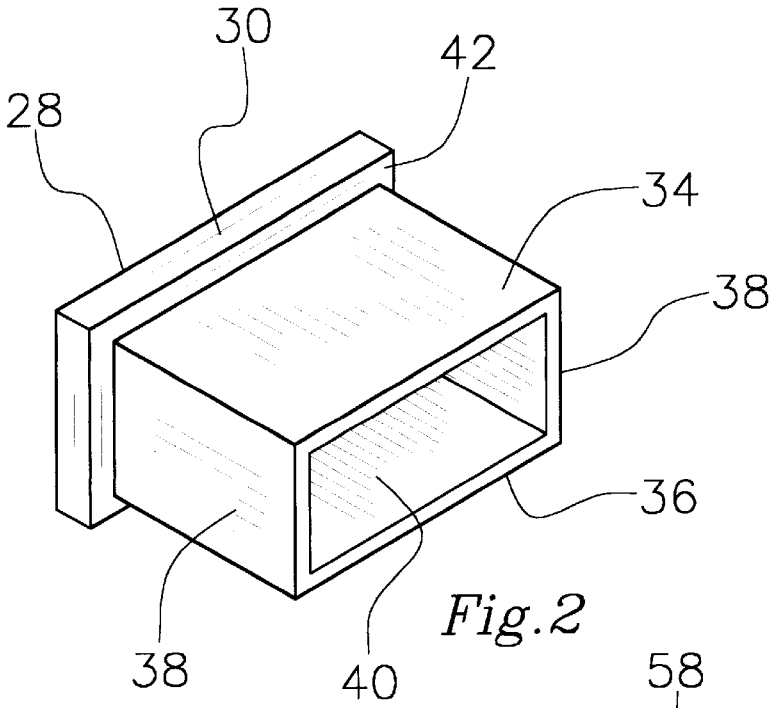
FIG. 2 is an enlarged perspective view of the cap of the present invention.
Figure 3:
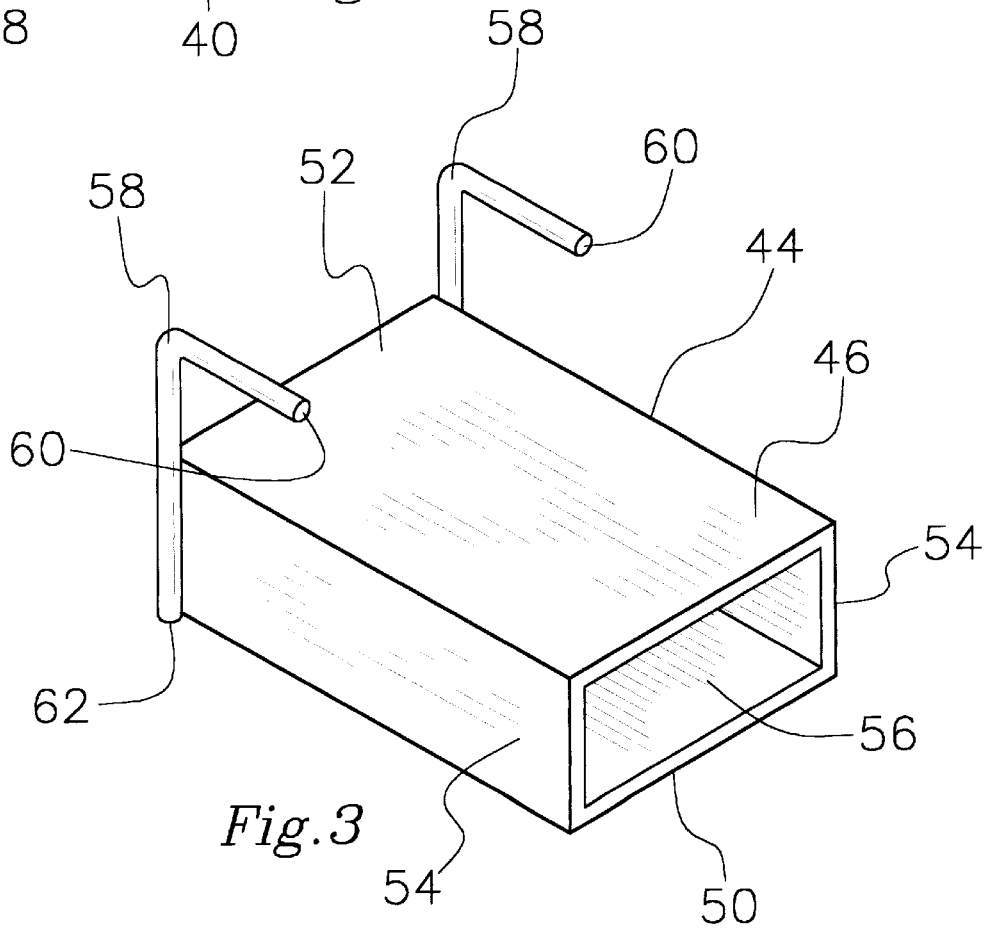
FIG. 3 is an enlarged perspective view of the alignment member of the present invention.

With reference now to the drawings, and in particular to FIGS. 1 through 3 thereof, a new stake protector embodying the principles and concepts of the present invention and generally designated by the reference numeral 10 will be described.

The present invention, designated as numeral 10, is adapted for use with a form board 12 having a planar exterior surface 16 and a top edge 18.

A stake 14 is also included having a pair of side edges 20, a top end, a pointed end 22, a front surface 24 and a back surface 26.

The present invention includes a cap 28 having a substantially planar rectangular top member 30 and an encasement member 32. The encasement member includes of a front wall 34, a rear wall 36 and a pair of side walls 38. The front wall and the rear wall are fixedly coupled to the side walls to form a first rectangular bore 40. The top member is fixedly coupled to the encasement member such that a lip 42 protrudes away from the encasement member around the periphery of the encasement member. The cap is for slidably receiving the top end of the stake. The cap provides for protection of the stake when a striking device is used to drive the stake into the ground. In the preferred embodiment the first rectangular bore has a length of three and five-eighths inches and a width of one and five-eighths inches to accommodate a stake made from a standard two by four wooden board.

Also included is an alignment member 44 having a rectangular sleeve portion 46 and a pair of holding portions 48. The rectangular sleeve portion includes of an exterior wall 50, an interior wall 52 and a pair of side walls 54. The exterior wall and the interior wall are fixedly attached to the side walls to form a second rectangular bore 56. The second rectangular bore is for slidably receiving the front surface, the back surface and the side edges of the stake. Each of the holding portions includes an L-shaped rod 58. The L-shaped rod includes a free end 60 and a fixed end 62. The fixed end is rigidly coupled to the sleeve portion adjacent to an outer top edge of one of the side walls of the sleeve portion. Each of the holding portions is adapted for receiving the top edge of the form board. The second rectangular bore has dimensions of three and five-eighths inches for a length, a width of one and five-eighths inches, and a depth of six inches. It should be noted that the intended use of the present invention is for a plurality of caps and alignment members to be used with a plurality of form boards and stakes to construct a concrete form. The alignment members are used to securely hold the form boards in a parallel relationship to the stakes when the stakes are being driven into the ground. The depth of the first rectangular bore is one half the depth of the second rectangular bore. The depth of the second rectangular bore has a ratio of one-third or less of the total length of the stake. The use of the cap and alignment members provides the form with a greater stability as well as a longer term of service.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A concrete form and stake securing system comprising, in combination:

a form board having a planar exterior surface and a top edge;

a stake having a pair of side edges, a top end, a pointed end, a front surface and a back surface;

a cap having a substantially planar rectangular top member and a encasement member, the encasement member including of a front wall, a rear wall and a pair of side walls, the front wall and the rear wall being fixedly coupled to the side walls to form a first substantially rectangular bore, the top member being fixedly coupled to the encasement member such that a lip protrudes away from the encasement member around the periphery of the encasement member, wherein the cap is for slidably receiving the top end of the stake; and an alignment member having a rectangular sleeve portion and a pair of holding portions, the rectangular sleeve portion including of an exterior wall, an interior wall and a pair of side walls, the exterior wall and the interior wall being fixedly attached to the side walls to form a second substantially rectangular bore, the second substantially rectangular bore being for slidably receiving the front surface, the back surface and the side edges of the stake, each of the holding portions including an L-shaped rod, the L-shaped rod including a free end and a fixed end, the fixed end being rigidly coupled to the sleeve portion adjacent to an outer top edge of one of the side walls of the sleeve portion, the holding portion being adapted for receiving the top edge of the form board.

2. A securing apparatus comprising:

a cap adapted for slidably receiving a top end of a ground engaging means;

an alignment member adapted for receiving a top edge of concrete retaining means and for slidably receiving the ground engaging means such that ground engaging means is rigidly held adjacent to the concrete retaining means;

wherein the alignment member includes a substantially rectangular sleeve portion and a plurality of holding portions; and wherein each of the holding portions includes an L-shaped rod.

3. A securing apparatus as set forth in claim 2 wherein the cap includes a top member and an encasement member, the encasement member having a bore centrally located therethrough.

4. A securing apparatus as set forth in claim 3 wherein the top member is fixedly attached to the encasement member such that the top member is oriented perpendicularly to a longitudinal axis of the bore such that a lip protrudes away from the encasement member around a periphery of the encasement member.

5. A securing apparatus comprising:

a cap adapted for slidably receiving a top end of a ground engaging member;

an alignment member adapted for receiving a top edge of concrete retaining form member and for slidably receiving the ground engaging member such that ground engaging member is rigidly held adjacent to the concrete retaining form member;

wherein the alignment member includes a sleeve portion and a plurality of holding portions; and wherein each of the holding portions includes an L-shaped rod.

6. A securing apparatus as set forth in claim 5 wherein the cap includes a top member and an encasement member, the encasement member having a bore centrally located therethrough.

7. A securing apparatus as set forth in claim 6 wherein the top member is fixedly attached to the encasement member such that the top member is oriented perpendicularly to a longitudinal axis of the bore such that a lip protrudes away from the encasement member around a periphery of the encasement member.

* * * * *